US009157253B2

(12) United States Patent
Rohrer, Jr.

(10) Patent No.: US 9,157,253 B2
(45) Date of Patent: Oct. 13, 2015

(54) PORTABLE DRIVING DEVICE

(76) Inventor: Daniel F. Rohrer, Jr., Prineville, OR (US)

( * ) Notice: Subject to any disclaimer, the term of this patent is extended or adjusted under 35 U.S.C. 154(b) by 522 days.

(21) Appl. No.: 13/598,500

(22) Filed: Aug. 29, 2012

(65) Prior Publication Data

US 2013/0112447 A1 May 9, 2013

Related U.S. Application Data

(60) Provisional application No. 61/575,883, filed on Aug. 29, 2011.

(51) Int. Cl.

| | |
|---|---|
| ***B25D 9/00*** | (2006.01) |
| ***B25D 11/00*** | (2006.01) |
| ***B25D 13/00*** | (2006.01) |
| ***E21B 1/00*** | (2006.01) |
| ***E02D 7/02*** | (2006.01) |
| ***E04H 17/26*** | (2006.01) |
| ***F15B 13/04*** | (2006.01) |
| ***F15B 21/12*** | (2006.01) |

(52) U.S. Cl.

CPC ..... *E04H 17/26* (2013.01); *F15B 13/0402* (2013.01); *F15B 21/12* (2013.01); *Y10T 137/86582* (2015.04)

(58) Field of Classification Search

CPC .. F15B 2201/411; F15B 13/021; F15B 15/02; F15B 2211/6309; F15B 2211/6355; B25D 17/26; E04H 17/263

USPC ..... 173/90, 48

See application file for complete search history.

(56) References Cited

U.S. PATENT DOCUMENTS

| | | | | | |
|---|---|---|---|---|---|
| 2,917,953 | A * | 12/1959 | Badali | 254/93 HP |
| 3,834,419 | A * | 9/1974 | Bozoyan | 137/625.63 |
| 4,071,046 | A * | 1/1978 | Cates | 137/596.15 |
| 4,130,168 | A * | 12/1978 | Deike | 173/38 |
| 4,337,796 | A * | 7/1982 | Bonney | 137/625.17 |
| 5,213,133 | A * | 5/1993 | Ellett | 137/596.14 |
| 5,819,857 | A * | 10/1998 | Rohrer | 173/90 |
| 2011/0155403 | A1* | 6/2011 | Rohrer | 173/114 |
| 2014/0262399 | A1* | 9/2014 | Cunningham | 173/133 |

* cited by examiner

*Primary Examiner* — Robert Long

(74) *Attorney, Agent, or Firm* — Portland Intellectual Property, LLC

(57) ABSTRACT

A portable driving device for permanently driving stakes, survey flags, posts, or the like, of varying sizes and shapes, into the ground. The invention provides for powering the device by a pressurized fluid with a single power cylinder, a valve control assembly including a self-exhausting spool valve controlled by a rod that runs through the spool valve, and safety switches in series for controlling delivery of pressurized fluid to the driving device.

5 Claims, 6 Drawing Sheets

PORTABLE DRIVING DEVICE

RELATED APPLICATIONS

This application claims the benefit of U.S. 61/575,883, filed Aug. 29, 2011, which is incorporated by reference herein in its entirety.

FIELD OF THE INVENTION

This invention relates to portable driving devices and in particular portable driving devices adapted for permanently driving stakes, survey flags, or posts, or the like, of varying sizes and shapes, into the ground, that are powered by a pressurized fluid. This invention also relates to a valve control assembly adapted for a portable driving device wherein a spool valve is controlled by a rod that runs through the middle of the spool valve. The invention also relates to a handle assembly adapted for a portable driving device wherein safety switches in series control delivery of pressurized fluid to the driving device valve control assembly.

BACKGROUND

The invention may be related to subject matter disclosed in the following U.S. Pat. Nos. 2,703,479; 3,712,389; 4,665,994; 4,984,640; 5,819,857; 6,182,772; 6,571,885; 6,776,242; 6,889,777; 6,932,166; 7,152,694; and 7,252,158, and U.S. Patent Application Publication 2002/0195273, which are hereby expressly incorporated by reference in their entireties.

SUMMARY

The present invention provides a portable reciprocating driving device which may include a valve control assembly and a pressurized fluid control assembly. Understanding the driving device from the reading of this document, may be facilitated by reference to the "Parts List" toward the end of this document. The improved driving device preferably comprises an inner rectangular sleeve (IRS) open at its lower end and closed at its upper end adapted to receive, for example, the upper vertical end of a reflective roadside post, which enable vehicle operators to track the location of the road relative to the reflective post with intention, typically, to drive the post permanently into the ground in the vicinity of the road's shoulder or thereabout. The IRS lower end opening and inner sleeve cross-sectional shape are adapted to receive such a sign or post or similar objects, including signs or posts or similar objects that are reflective (hereinafter inclusively referred to as "post") with a cross-sectional shape that is typically and in this case as well is preferably rectangular, which allows the post to be fully inserted into the IRS such that the top end of the post engages the inside top of the IRS. The device also includes an outer rectangular sleeve (ORS) open at its lower end and closed at its upper end adapted to receive and securely and slidably engage the IRS—ergo the rectangular cross-sectional shape.

Cross-sectional shapes of the inner and outer sleeves need to be compatible with each other and the inner sleeve has a cross-sectional shape compatible with the top end of the object to be driven by the device. Therefore, it must be understood that the shape of the sleeves could be of varying cross-sectional shape. As long as the inner sleeve can receive the top of the object to be driven such that it can be effectively driven by the outer sleeve impacting the inner sleeve and the portion of the respective sleeves that are slidably engaged—the subject invention, and its alternative embodiments, will be functional within the scope of this specification.

The device also includes: a fluid power cylinder (FPC) releasably affixed to the ORS; and a base block (BB) releasably affixed to the IRS with a valve control rod (VCR) releasably affixed thereto. The device also includes a fluid power cylinder connecting rod (FPCCR) releasably affixed to the BB at the lower end of the FPCCR and affixed to fluid power cylinder piston (FPCP) (not illustrated) at its upper end, wherein FPCP resides and reciprocates within the FPC.

The device also includes a valve box (VB) adapted to sealably permit the VCR and FPCCR to pass therethrough wherein the VCR controls a spool valve mechanism, and extends through the spool valve (which is disposed in the VB), which alternately directs pressurized fluid, from an external source into opposite sides of the FPCP (which is disposed in the FPC), thereby creating reciprocating motion between the ORS and IRS 30. The VB is adapted to be self cleaning in that it expels the pressurized fluid, preferably air (or a functional equivalent thereof), from alternating sides of the VB cylindrical chamber which houses the spool valve mechanism therein without the need for a designated exit port or ports. The device also includes a nut, spring, and washer which are preferably respectively located at the upper end of the VCR and preferably a spring and washer are respectively located at the lower end of the VCR—intermediate to the VB and BB.

The device may also include, fixed to the lower end of the IRS, a handle assembly (HA). The upper end of the post, which is intended to be hammered so that the lower end of the post may be driven into the ground, is inserted into the open lower end of the IRS until it engages the upper inner closed end of the IRS, the HA may control the delivery of fluid to the VB, which is in effect an ON/OFF switch for the portable driving device. Each handle of the HA includes a switch which opens a valve which is biased closed when pressurized. When each handle switch is activated pressurized fluid is delivered from an external source to the VB.

The HA may also include a fluid actuated means for engaging and securing the IRS to the upper portion of the post (not shown in Figures). For example the second handle switch may deliver pressurized fluid to both the VB and a means for securing the IRS to the post, such means being known and which may include providing a pin which is biased in a retracted position and which, when pressurized, presses the top of the post to an inner surface of the IRS. However, alternatively the weight of the device, and the operator's ability to hold the device on the post, which in turn may stabilize the driving device IRS in relationship to the post (and the ORS during operation) and which may keep the inner closed end of the IRS sufficiently engaged with the top of the post during operation—that is, when the device is pounding the post into the earth as the reciprocating motion of the ORS relative to the IRS.

The present invention is accordingly adapted and calibrated to drive the post into the ground by generally keeping the inner closed end of the IRS engaged with the top of the post wherein the VB control of pressurized fluid creates reciprocating motion between the IRS and the ORS wherein the top closed end of the IRS receives repetitive reciprocating impact blows from the inner closed end of the ORS thereby driving the post into the earth.

DETAILED DESCRIPTION

A preferred embodiment of a device for power driving objects will now be illustrated and disclosed. The following description will also include alternative embodiments of the preferred embodiment. The portable driving device 10 is illustrated in the Figures and Drawings (listed above) and is comprised of the parts listed in "Parts List." The device is adapted to drive a post, or generally any elongated article, into the ground or other medium as desired. The preferred embodiment, however, is adapted to drive a post with substantially rectangular cross-sectional shape which substantially fits within such a rectangular space defined by the driving device—specifically IRS 30. The preferred embodiment disclosed and illustrated is specifically adapted to drive road-side posts (which are typically used to support "road-signs") common along the soft shoulders, or similar features, of rural roads. Notwithstanding, the inventive embodiments disclosed herein are equally applicable to a portable driving device adapted to drive a post or an object with a substantially round cross-sectional shape, square cross-sectional shape or for that matter may be adapted for any shape. IRS 30 and ORS 20 merely need to be adapted to this cross-sectional shape—the inventive embodiments disclosed herein as they pertain to the mechanisms that generate reciprocating movement between the ORS 20 and the IRS 30 may be applied to a variety of sizes and shapes of the post and the energy required to drive them into a medium such as soil.

The portable power portable power driving device 10 may utilize an innovative valve control mechanism which is particularly useful for reciprocating devices powered by fluids including pneumatic devices powered by compressed air.

The innovative portable power portable power driving device 10 may utilize an innovative switch control mechanism which when properly utilized may provide for a safe power driving device.

Figure 1:
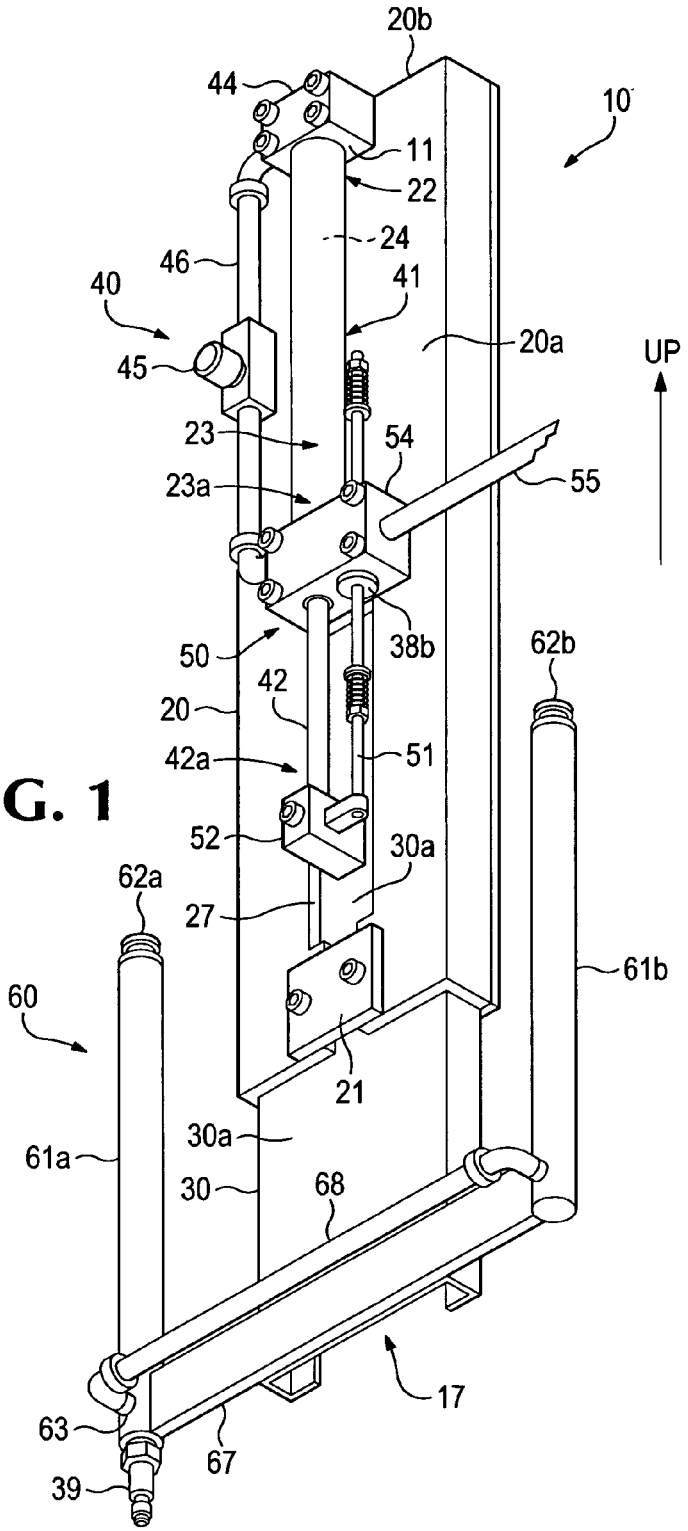
FIG. 1 is a top isometric view of a first embodiment of a driving device.
Figure 2:
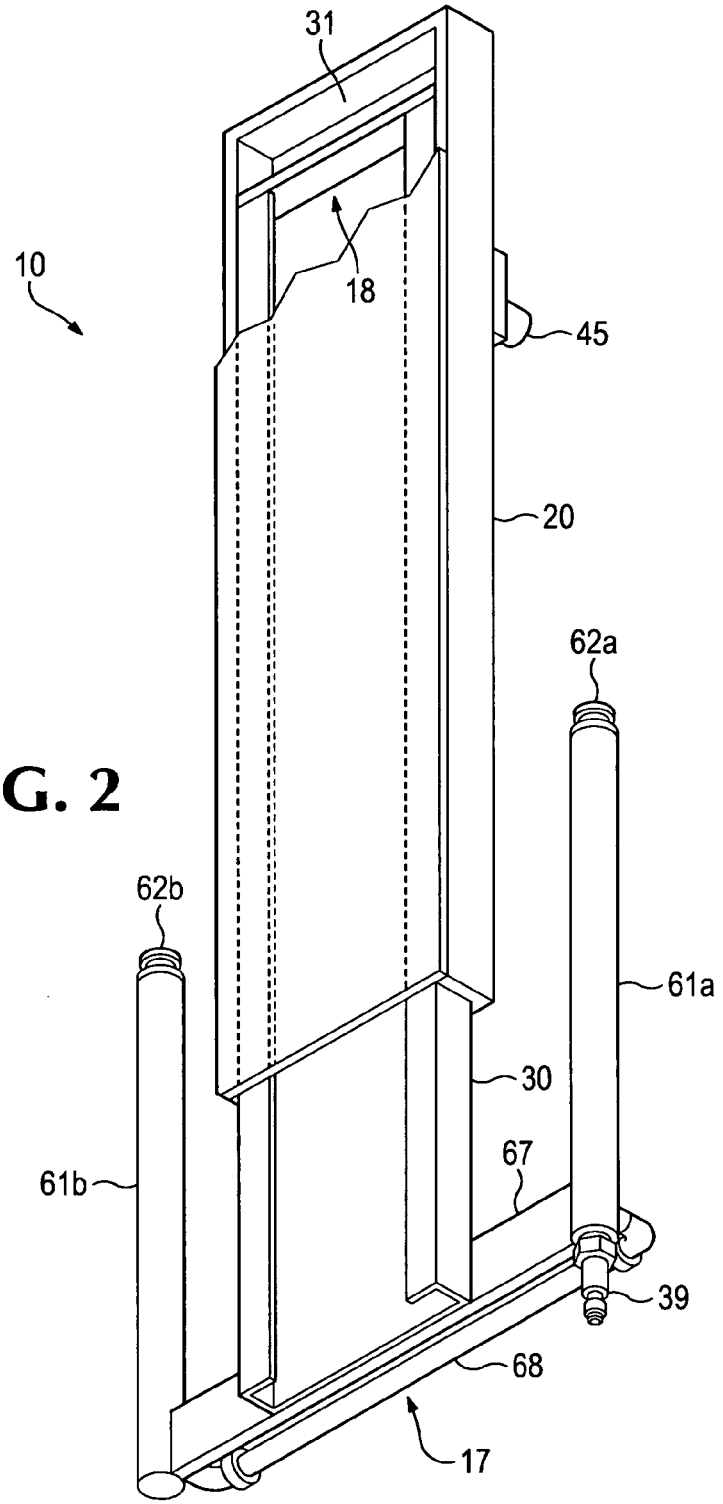
FIG. 2 is a bottom isometric view of the driving device of FIG. 1.

Referring to FIGS. 1 and 2 showing a preferred embodiment of an improved portable power driving device 10 according to the invention, the device includes IRS 30 and ORS 20. IRS 30 is open at a lower end 17 thereof (referencing "UP" in FIG. 1), and closed at an upper end 18 thereof, adapted to receive the upper end of a post (not illustrated). The upper end of the post, which is opposite the end which is to be driven into the ground, is preferably slid into the lower (open) end 17 of IRS 30, until the top of the post engages an inside surface of the upper end 18 of IRS 30 (see FIG. 2). Reflective posts are common on roadsides throughout the world to visually aid drivers at night—they reflect electromagnetic radiation from, for example, a vehicle's headlights, or similar devices. Such reflective posts have varying cross-sectional shapes; however, many may be slid inside IRS 30 as illustrated herein, and may be effectively hammered thereby into the ground by portable power driving device 10.

As noted above, ORS 20 includes an open lower end 17 and a closed upper end 18 wherein IRS 30 and ORS 20 are adapted to be slidably engaged. Such an engagement can be achieved by many means known in the art including matching the respective cross-sectional shapes, material specifications and dimensional tolerances, of IRS 30 and ORS 20 illustrated and described herein.

The elongated cylindrical FPC 41, with a round cross-sectional shape, may be vertically aligned with ORS 20 and fixed to an upper end 11 (referencing "UP" in FIG. 1) of the outside top of the ORS 20, and preferably releasably fixed at the upper end and lower end of FPC 41 to provide adequate structural integrity and stability for typical use of the portable power driving device 10. An upper end 22 of the FPC 41 includes structurally sound means to releasably affix FPC 41 to ORS 20 and includes means to deliver fluid to the interior volume of the upper end of FPC 41—namely FPCUB 44—which is releasably connected to the ORS 20. As illustrated in the preferred embodiment pneumatic connector 55 (including a manual valve as shown in FIG. 1) provides means to get compressed air from VB 54 to FPCUB 44. That is, FPCUB 44 is connected to FPC 41 wherein compressed air from VB 54 is ultimately delivered to the upper inner portion 24 of FPC 41 through FCP 40.

Figure 3:
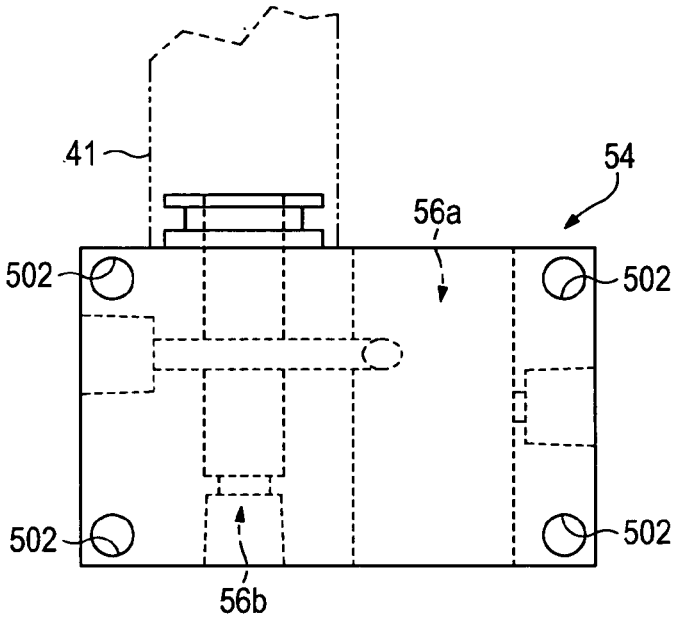
FIG. 3 is plan view of a preferred embodiment of a valve box portion of the driving device of FIG. 1.
Figure 4:
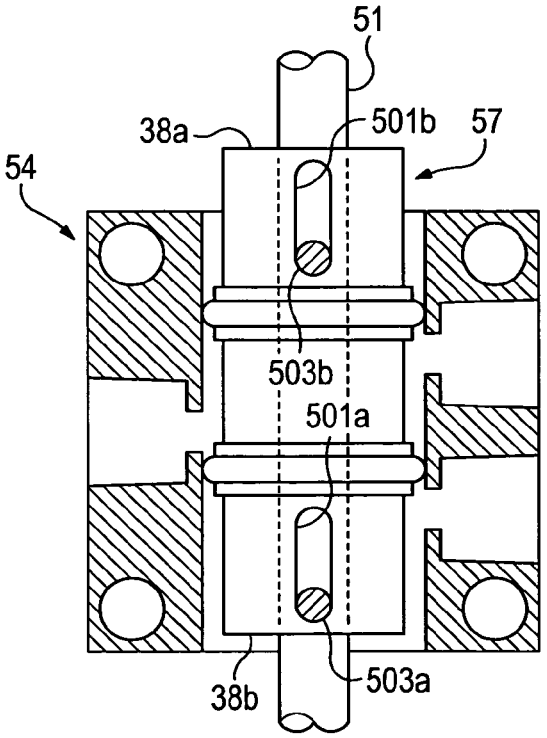
FIG. 4 is a top sectional view of an alternative embodiment of the valve box portion of FIG. 3 with a spool valve.
Figure 5:
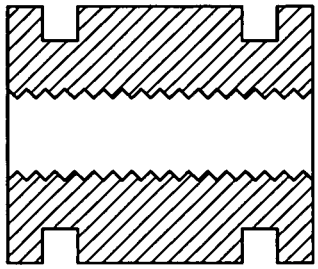
FIG. 5 is a top sectional view of a spool valve showing concave tracts for O-rings.
Figure 6:
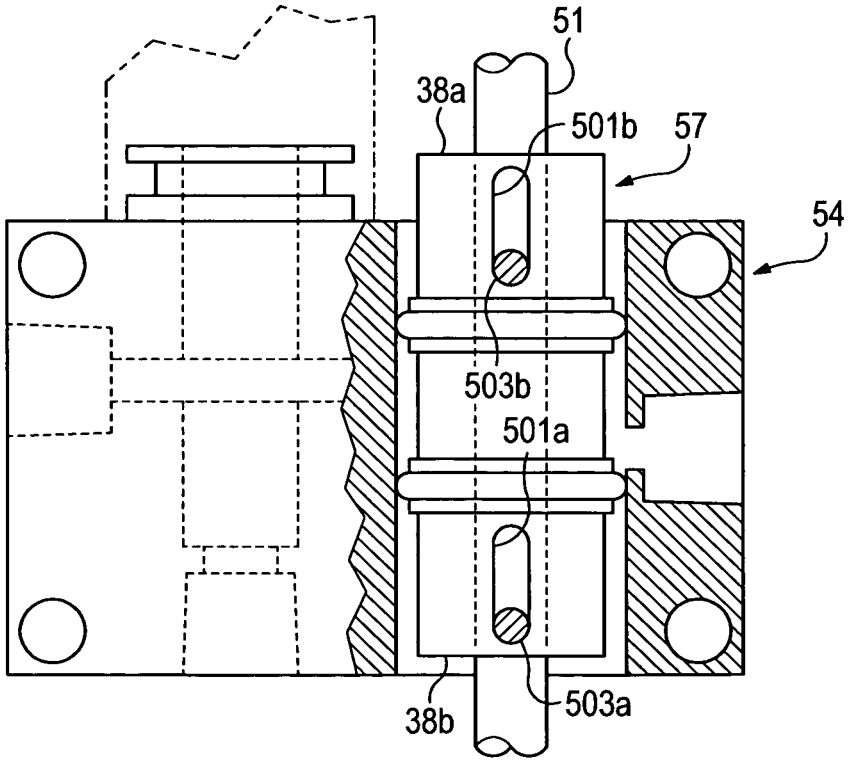
FIG. 6 is a top sectional view of the valve box portion of the driving device of FIG. 1 with the spool valve of FIG. 4.

VB 54 is illustrated in detail in FIG. 3. VB 54 has a first chamber 56*a* and a second chamber 56*b*. Reference should also be made to FIG. 4, which illustrates a cross-sectional side view of a spool valve 57 within a valve box body (not the preferred embodiment of the subject invention). FIG. 5 illustrates a detailed cross-sectional view of a spool valve detailing a concave tract for O-rings as is well known in the art. With additional reference to FIG. 6, showing the spool valve 57 of FIG. 4 in the VB 54 of FIG. 3, and FIG. 7, the first chamber 56*a* is adapted to receive the spool valve 57 wherein spool valve 57 is adapted to sealably reciprocate within the first chamber 56*a* and wherein the spool valve 57 is adapted to sealably allow VCR 51 to reciprocate therethrough. Second chamber 56*b* is adapted to allow FPCCR 42 to reciprocate therethrough. FPCCR 42 must be sealably allowed to reciprocate into and out of the lower end 23 of FPC 41. In the preferred embodiment of the subject invention an extreme end portion 23*a* of the lower end 23 of FPC 41 is sealably and releasably affixed to VB 54. FPCCR 42 passes through VB 54 (its body). The spool valve, which is not illustrated in its entirety (but see FIG. 4), sealably articulates within the first chamber 56*a* of VB 54 and the range of the spool valve's upward and downward movement may be defined by threaded stop chambers (or slots) 501*a* and 501*b*, left and right respectively as shown in FIG. 4, in the top of VB 54 wherein corresponding stops 503*a* and 503*b* may be screwed into the top of the VB 54 to limit, or stop, the upward and downward range of the spool valve's reciprocation within spool valve chamber 56*a* of VB 54. The slots (501*a* and 501*b*) are shown disposed in the top of the spool valve 57 and extending, in an upward and downward directions, beyond a middle sealed portion 26 of the spool valve (see FIG. 4). VCR 51 sealably articulates through the middle sealed portion 26 of the spool valve within the spool valve chamber 56*a*.

VB 54 includes a fluid connector, preferably a pneumatic connector 55, which can be sealably connected to a portable air, or fluid, source such as a small portable air compressor of the type that is well-known in the art. The lower end 23 of FPC 41 is fixed to the approximate middle of the outside top surface 20*a* of ORS 20 at VB 54. VB 54 includes means for alternately directing, via the spool valve, fluid to the interior volume 24 of the upper end of FPC 41. Fluid is directly delivered to the interior volume of the lower end 23 of FPC 41 from VB 54.

VB 54 may also include four threaded chambers (or holes) 502 which provide means by which VB 54 may be releasably affixed to ORS 20. One means therefore would be with four threaded bolts which may extend through the four chambers 502 (FIG. 3) from the top of VB 54 wherein the bottom of the four bolts may be screwed into and aligned with matching threaded holes in ORS 20 as illustrated in part in FIG. 1.

Figure 7:
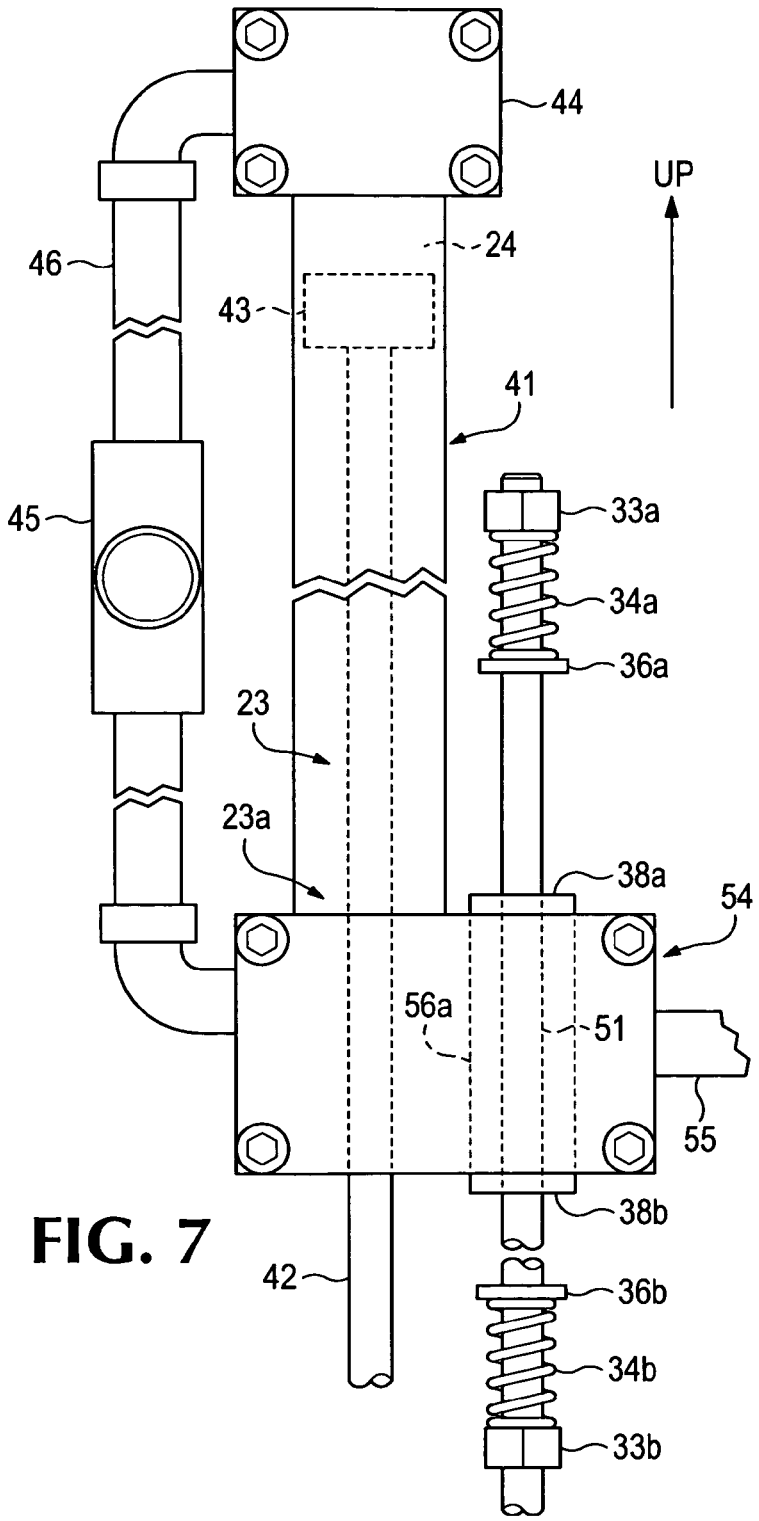
FIG. 7 is a top view of a portion of the driving device of FIG. 1, showing additional detail.

FPCCR 42 is releasably affixed to FPCP 43, the latter component illustrated in FIG. 7, at the upper end of FPCCR 42 (referencing "UP" in FIGS. 1 and 7), and the FPCP 43 divides FPC 41 between the interior volume 24 of the upper end and the interior volume of the lower end 23. The affixation is of a sealable and structural nature consistent with reciprocating pressurized fluid power devices well-known in the art. A lower end 42*a* of FPCCR 42 is affixed to the BB 52. The BB 52 is releasably affixed to the approximate middle of an outside top surface 30*a* of IRS 30, and projects through a corresponding slot 27 in ORS 20. The lower ends of FPCCR 42 and VCR 51 are affixed to the BB 52, preferably releasably affixed.

Both FPCCR 42 and the VCR 51 pass through the body of VB 54. The means for sealing this interface is well-known in the art.

With reference to FIG. 7, VCR 51 controls the spool valve 57 in VB 54 thereby alternately delivering fluid to the two ends (i.e., the interior volume 24 of the upper end, and the interior volume of the lower end 23) of FPC 41. With additional reference to FIG. 1, when fluid is delivered to the interior volume 24 of the upper end of FPC 41 (from VB 54 through FPCC 46), FPCP 43 (shown in FIG. 7) is driven from being closer to an upper end 20*b* of ORS 20 (referencing "UP" in FIGS. 1 and 7) to being generally closer to the middle of ORS 20. Because FPCCR 42 is affixed to BB 52, which is affixed to IRS 30 and therefore can translate within the slot 27 in ORS 20, relative motion between IRS 30 and the ORS 20 is created. When the interior volume 24 of the upper end of FPC 41 is "filled" (based upon calibration of the driving device) preferably prior to the top (referencing "UP" in FIG. 1) of the cover 21 of ORS 20 interfering with the BB 52, and preferably prior to FPCP 43 bottoming in FPC 41 at the extreme lower end 23*a* thereof, VCR 51 engages the spool valve 57 internal to VB 54 and fluid is directed to the interior volume of the lower end 23 of FPC 41, thereby pushing FPCP 43 back up toward the interior volume 24 of the upper end of FPC 41. Next, as fluid is directed by VB 54 to the interior volume of the lower end 23 of FPC 41, ORS 20 is driven down toward IRS 30 until an inner closed end 31 (see FIG. 2) of ORS 20 engages the inside surface of the closed upper end 18 (see FIG. 2) of the IRS 30 whereupon an impact load/force is produced between the IRS 30 and the ORS 20 and is thereby delivered to the post. As noted previously, preferably two stops are bolted into the top of VB 54 to limit the external travel of the spool vis-à-vis VB 54.

The portable power driving device 10 is calibrated so that the impact load is delivered prior to FPCP 43 hitting the ceiling of the interior volume 24 of the upper end of FPC 41 and prior to VB 54 hitting BB 52. The device is calibrated so the impact load is delivered whereupon VCR 51 engages the spool valve 57 in VB 54 and fluid is directed back to the interior volume 24 of the upper end of FPC 41 and the cycle is repeated.

When the portable power driving device 10 is vertically oriented and a vertically oriented post has been engaged at its upper end by the inner closed end of IRS 30, and the vertically oriented post has been engaged into the soil or a similar medium at its lower end—then the post is driven downward into the soil or similar medium.

Notably, the portable power driving device 10 does not require IRS 30 to be fixed to the post. Although the driving device is small and light-weight, its weight, in combination with the strength of an average user, enable the secure installation of a post without the need for means for removable fixing IRS 30 to the post. In one embodiment of the subject invention components are made of aluminum, with the exception of impact surfaces or components, wherein the device will weigh approximately 12 pounds, whereas an all steel unit will weigh approximately 20 pounds. The portable driving device 10 economically allows for such low weights vis-à-vis the prior art.

Preferably, fixed to the lower end 17 of IRS 30 is a handle assembly HA 60, shown in FIG. 1. The upper end of the post, which is to be driven into the ground, is inserted into the open lower end 17 of IRS 30 until the upper end of the post engages the inside surface of the closed upper end 18 of IRS 30 (see FIG. 2). Then, the HA 60 may be activated with a switch control (switches 62*a*, 62*b* in FIG. 1), providing fluid actuation means for securing IRS 30 to the post.

Preferably, the HA 60 includes two handle bars 61*a* and 61*b* to be gripped firmly by the user—a 0.75 inch O.D. is preferred. Sponge handle grips are also preferably provided on the handle bars, for ergonomically absorbing the shock associated with the reciprocating motion and impact loads delivered. For example, bicycle handle bar grips or handle bar tape, known in the art, are designed for such approximate handle O.D. sizing. At the upper ends of the handles are the switches 62*a* and 62*b*, referred to herein as "hand switches," which are easily thumb activated. Preferably the portable power driving device 10 is not activated, i.e. air is not delivered to VB 54, until both hand switches are engaged. Thus when either hand switch is disengaged, air delivery to VB 54 is terminated. Means for providing for fluid communication between the hand switches and the supply of air to VB 54 are well-known in the art.

Alternatively, the hand switches of HA 60 may obtain the compressed air from an external source, in which case they function as simple pneumatic switches which are well-known in the art. Moderate pressure and volumes of air are necessary for such safety switch functions—and little if any pressurized fluid.

Alternatively, one of the HA hand switches 62*a* or 62*b* may activate a pneumatic clamp for releasably securing IRS 30 to a post. The necessary compressive force ultimately securing IRS 30 to the post will be commensurate with the forces necessary to drive the post. Only upon activation of both switches is air delivered to the FPC 41 and hammering of the post commenced.

As shown in FIG. 1, handle brace bar 67 connects handles 61*a* and 61*b* and may be welded or releasably affixed to IRS 30. Alternative means known in the art may be utilized to connect handles 61*a* and 61*b* to IRS 30 in a structurally sound manner.

Alternatively, IRS 30 may be secured to the post by manual means known in the art such as a simple set screw and threaded aperture in the lower portion of the top of IRS 30. Disengaging either switch, which is easily achieved by releasing a thumb, which the user may do voluntarily or involuntarily, serves a valuable safety purpose. It is critical and desirable that both hands remain on the HA hand grips as this insures safer operation of the portable driving device 10 as even a hand that slides down a hand grip may not have optimal control of the device.

The portable power driving device 10 utilizes approximately 5.5 inches to 7 inches of travel at 50 to 150 psi (compressed air). The overall length of the device is approximately 20 inches—notably shorter than, for example, prior art units employing dual power cylinders. The device is approximately 6 inches wide and 0.75 inches deep. The device requires approximately 2 cubic feet of air, which is notably less than prior art units, including those with dual power cylinders. As noted previously, if the device is formed of steel, the approximate weight is 20 pounds. The device delivers an impact load approximately every 0.75 seconds. However, the impact frequency may be affected by the source of fluid. For example, 50 psi (air pressure) will produce an impact frequency of approximately 60 impacts per minute, whereas 120 psi may produce an impact frequency of 130 impacts per minute. Regulators are well-known in the art as a means of controlling the pressure of fluid delivered to VB 54.

The device 10 is scalable for different impact loads, different cross-sectional shapes of posts, and different fluids used to power the device.

The subject invention is versatile. It can be made proportionally larger, while still utilizing the innovative valve control box and hand switch valve control assembly disclosed herein even though the preferred embodiment is disclosed is for use with a relatively small post, having a rectangular sleeve design, with rectangular impact surfaces in the sleeves.

Preferably, each end of VCR 51 is threaded with a nut, and proximate the nuts are springs and washers. So, with reference to FIG. 7, VCR 51 has upper and lower nuts 33*a* and 33*b* threadably attached thereto, and carries upper and lower springs 34*a* and 34*b*, and upper and lower washers 36*a* and 36*b*, respectively. The washers tamp and therefore make contact with corresponding faces 38*a* and 38*b* of the spool valve 57, which will protrude external to VB 54 when directing fluid to one or the other side of FPC 41, and therefore which will be available for making contact with the corresponding one of the upper and lower washers. An example of such protrusion is shown in FIG. 6, showing particularly protrusion of the face 38*b*.

With reference to FIG. 7, when fluid is directed to the interior volume 24 of the lower end of FPC 41, the piston 43 and FPCCR 42 will be driven downwardly (referencing "UP" in FIGS. 1 and 7), pulling VCR 51 along with it until the upper washer 36*a* engages the spool valve, causing the upper spring 34*a* to become compressed against the upper face 38*a* of the spool valve 57 and eventually force the spool valve downwardly with the result that the lower 38*b* will protrude from the bottom side of the VB 54 as shown in FIG. 6. The same principle of operation necessarily functions in reverse, where as a result of the aforedescribed change in position of the spool valve, fluid becomes directed to the interior volume of the lower end 23 of FPC 41, eventually causing the lower washer 36*b* to make contact with the lower face 38*b* of the spool valve 57.

Calibration of the drive stroke, that is when VB 54 directs fluid into the interior volume of the lower end 23 of FPC 41, may be in part effectuated according to the spring rate of the lower spring 34*b* on the lower end of VCR 51. The spring rate may be varied to absorb varying amounts of energy per unit of displacement to impact when fluid directed to the interior volume of the lower end 23 of FPC 41 is terminated. Higher source pressure results in greater impact as more energy is required to move the spool valve.

It should be noted that the innovative VB 54 allows air to exit the side of the spool valve 57. This allows VB 54 to be closed to the external pressurized fluid source as opposed to requiring an exhaust port or ports. Specifically, when fluid is directed to the interior volume 24 of the upper end of the FPC 41, through FPCC 46 (FIG. 1), and ORS 20 is moving upwardly relative to IRS 30, fluid is, and critically needs to be, exiting from the interior volume of the lower end 23 of FPC 41. At such time fluid exits the interior volume of the lower end 23 of the FPC 41 directly into VB 54 and out one side of the spool valve chamber 56*a* (the side not occupied by the spool valve) in VB 54. And when fluid is directed to the interior volume of the lower end 23 of FPC 41, and ORS 20 is moving downwardly relative to IRS 30, fluid is, and critically needs to be, exiting from the interior volume 24 of the upper end of FPC 41, through FPCC 46, into VB 54 and out the other side of the spool valve chamber 56*a*.

It should be noted that suitable seals are well-known in the art to enable the portable driving device 10 to function properly and reliably even though there are moving parts therein, notably the VCR 51 and FPCCR 42, which oscillate in and out of the pressurized VB 54.

Preferably when the portable driving device 10 is at rest ORS 20 is down—that is, the interior volume of the lower end 23 of FPC 41 is filled with fluid and so the device is collapsed into a configuration of minimum length.

It should be noted that the portable driving device 10 allows for compactness with an economy of space and parts. All valve assembly components, and all means of control thereof, are within the footprint of the ORS 20 and the device 10 need not employ more than a single power cylinder.

The subject invention is preferably constructed of components which are bolted together although alternatively welded components are viable. It will become apparent that bolted components will allow the subject driving device to be modular wherein the power driving components can be disassembled and reassembled—namely, bolted to an alternative IRS 30 and compatible ORS 20 which are cooperatively adapted for a post of alternative cross-sectional dimensions. For example, ORS 20 may break down into five components: a top, a bottom, two side panels and a closed end. For example, the top and bottom may be used for a post that has a similar cross-sectional length but a greater width, which would require the side panels and closed end to have a greater height. For example, preferably for a reflective post ORS 20 has a length of approximately 20 inches and a width of approximately 5 inches and a depth or thickness of approximately 1.5 inches.

Alternatively, ORS 20 need not break down into fewer components. However, what is preferred, to provide modularity which will also ease service to individual components, is for the BB 52 to be releasably affixed to IRS 30, and VB 54 and FPCUB 44 to be releasably affixed to ORS 20. Accordingly, the fluid power assembly, which includes FPC 41, FPCCR 42, FPCP 43, and FPCUB 44, and the VCA 50, which includes VCR 51, BB 52, and VB 54, may be removed and affixed to an alternative ORS and compatible IRS. As illustrated in FIG. 1, four bolts releasably affix VB 54 to the ORS 20 and four other bolts releasably affix the FPCUB 44 to ORS 20. Two other bolts, not illustrated, affix the BB 52 to IRS 30; preferably, these other two bolts have flat heads, with the corresponding bolt-holes being countersunk with chamfer angles to match the bolt heads, to keep the inside surface of IRS 30 flush and thereby eliminate any projections from this surface which could impede or block or scrape the post inserted into IRS 30 as a result of relative motion between the IRS 30 and the post.

Alternatively, the slot in ORS 20 may extend to its bottom end and a cover plate 21 (FIG. 1) for the BB 52 may function as a stop for BB 52.

The handle assembly HA 60, and the hand switches 62*a*, 62*b*, and the aforementioned means for providing fluid communication between the hand switches and the supply of air, which may be referred to as a hand switch valve control assembly, may be releasably affixed to IRS 30 at its lower end adding another, if necessary, modular component, since the handle assembly and hand switch valve assembly communicates solely with VB 54 with an appropriate fluid.

It should also be noted that the portable power driving device 10 allows for the handle to remain fixed in space during operation of the device—excluding the time the ORS 20 impacts the IRS 30 which in turn drives the post into the ground/soil/other. This makes for a portable driving device that is more user friendly and ergonomic.

Figure 8:
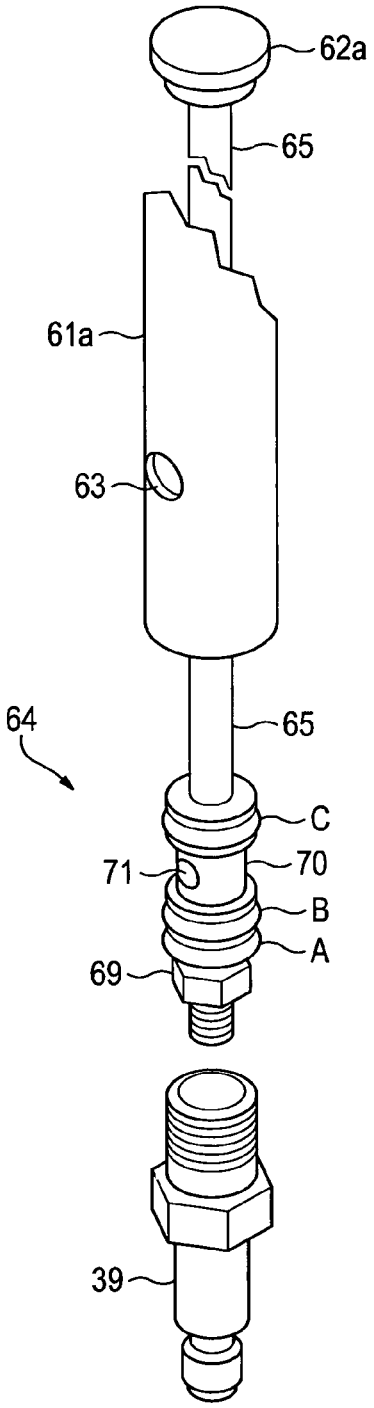
FIG. 8 is a top isometric exploded view of a handle and handle valve assembly of the driving device of FIG. 1.
Figure 9:
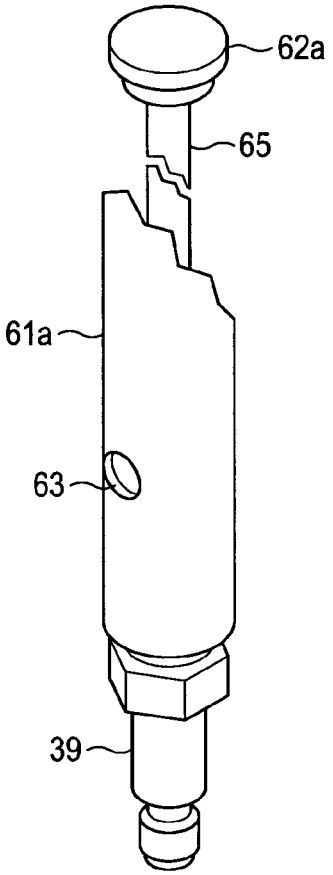
FIG. 9 is a top isometric assembled view of the handle and handle valve assembly of FIG. 8.

The HA 60 with pressurized fluid control is depicted in part of FIG. 1 and in detail in FIGS. 8 and 9. A bottom portion of one of the handles, which is shown as 61*a*, includes source intake means 39 for connecting to an external source of pressurized fluid (see pneumatic connector 55). Also, the intake handle includes an aperture 63 for connection to means by which to divert pressurized fluid from the intake handle 61*a* to the other handle 61*b* as illustrated in FIG. 1, such means being shown in FIG. 1 as handle conduit 68. FIG. 8 also illustrates a handle valve assembly 64 which is sealably affixed to and resides on a switch shaft 65 and is slid into the interior volume of the handle 61*a* along with the switch shaft 65 as can be seen by comparing FIGS. 8 and 9. The assembly, structure and function of the handle valve assemblies will be readily appreciated by persons of ordinary skill in the art in view of the disclosure herein.

The handle valve assembly 64 has an internal portion including a recessed core 70 with an aperture 71. When switch 62*a* is not engaged, a pressure nut 69 presses an O-ring A against the handle valve assembly. Therefore when external fluid is supplied to the interior volume of the handle 61*a* through the source intake means 39, the O-ring A prevents fluid from entering the handle valve assembly 64 along the switch shaft and into the internal portion thereof. When air is allowed to pass O-ring A, along the switch shaft and into the internal portion of the handle valve assembly, then O-ring B and O-ring C prevent air from escaping into the interior volume of the handle 61*a* and air is diverted out of the aperture 71.

When switch 62*a* is engaged the handle valve assembly does not move—it remains aligned with the aperture 63, however the switch shaft 65 moves (typically downwardly) the pressure nut 69 away from O-ring A, thereby allowing O-ring A to float, or flutter, thereby allowing compressed fluid to enter into the inner body of the handle valve assembly and exit the handle valve assembly aperture 71 and out the aligned aperture 63 in handle 61*a*, which in turn provides pressurized fluid to handle 61*b* via the handle conduit 68.

On the other hand, when hand switch 62*a* is not engaged, the pressure nut 39 seals O-ring A against the handle valve assembly. Only upon engaging switch 62*a* is the O-ring A allowed to float.

Manual switches 62*a* and 62*b* a will not be sealed so air exits after operation and both switches are released.

Handle 61*b* is essentially identical to handle 61*a* with the exception that there is no intake means 39, and pressurized fluid exiting the aperture 63 in the handle 61*b* is delivered to a device which requires, or preferably includes, a two switch means by which to control the delivery of pressurized fluid. It is not illustrated in FIG. 1 but in the preferred embodiment of the subject invention a means to deliver pressurized fluid from handle 61*b* to the intake connector 55 of VB 54 may include the appropriate sealed connections and a hose or a conduit similar to that utilized for directing pressurized fluid from VB 54 to FPCUB 44.

While specific embodiments of the invention have been described in detail, it will be appreciated by those skilled in the art that there are modifications and alterations that do not depart from the inventive concepts disclosed herein. Accordingly, the particular arrangements disclosed are meant to be illustrative only and not limiting as to the scope of the invention which is to be afforded the full breadth of the disclosure and any and all equivalents thereof. For example, while the subject invention is directed to post driving devices the innovative driving mechanisms disclosed herein may be adapted for utilization with fracturing devices such as jack-hammers or other devices that can utilize reciprocating motion.

Moreover, while the disclosure herein focuses on embodiments which have FPC 41 releasably affixed to ORS 20, and the BB 52 releasably affixed to IRS 30, it is fully within the scope of the subject invention to have FPC 41 releasably affixed to IRS 30 and the BB 52 releasably affixed to ORS 20 with accompanying design modification, which would not require independent invention or undue experimentation from one skilled in the art.

Additionally, while embodiments of the subject invention are described as having components that are releasably affixed to other components, it should be appreciated that this is to improve the modularity of the subject invention and does not limit the invention to releasably affixed components, and so components may be affixed to other components within the scope of the invention by non-releasable means.

PARTS LIST

10 portable driving device
17 lower end of IRS 30
18 upper end of IRS 30
20 ORS—outer rectangular sleeve
20*a* outside top surface of ORS 20
20*b* upper end of ORS 20
21 cover plate
22 upper end of FPC 41
23 lower end of FPC 41
23*a* extreme end portion of 23
27 slot in ORS 20
30 IRS—inner rectangular sleeve
30*a* outside top surface of FRS 30
31 upper closed end of ORS 20
33*a* and 33*b* upper and lower nuts attached to VCR 51
34*a* and 34*b* upper and lower springs carried by VCR 51
36*a* and 36*b* upper and lower washers carried by VCR 51
38*a* and 38*b* faces of spool valve 57
39 source intake means for HA 50
40 fluid power assembly
41 FPC—fluid power cylinder
42 FPCCR—fluid power cylinder connecting rod
42*a* lower end of FPCCR 42
43 FPCP—fluid power cylinder piston
44 FPCUB—fluid power cylinder upper box
45 fluid power cylinder conduit safety valve
46 FPCC—fluid power cylinder conduit
50 VCA—valve control assembly
51 VCR—valve control rod
52 BB—base block
54 VB—valve box
55 pneumatic connector

56*a* and 56*b*—chambers of VB 54
57 spool valve
501*a* and 501*b*—slots in VB 54
503—VB threaded chambers
503 stops in VB 54
60 HA—handle assembly
61*a* and 61*b* handle bars
62*a* and 62*b* hand switches
63 first and second handle apertures
64 first and second handle valve assemblies
65 switch shaft
67 handle brace bar
68 handle conduit
69 pressure nut
70 recessed core of handle valve assembly 64
71 aperture through recessed core 70
O-rings A, B, and C

What is claimed is:

1. A post driver, comprising:

a frame portion and a post-driving portion slidably connected to the frame portion;

a piston slidably disposed within a cylinder which divides the cylinder into two chambers, wherein the piston is connected to one of the frame and post-driving portions of the post driver, and the cylinder is connected to the other of the frame and post-driving portions of the post driver; and a spool valve adapted for receiving pressurized fluid from a source and repetitively alternately diverting the pressurized fluid into the two chambers so as to cause the piston to reciprocate in the cylinder and the post-driving portion to reciprocate relative to the frame portion, wherein the post-driving portion includes a rectangular sleeve having an open lower end for receiving a post therethrough, the rectangular sleeve having a width of approximately 5 inches and a depth of approximately 1.5 inches.

2. The post driver of claim 1, wherein the rectangular sleeve has a length of approximately 20 inches.

3. The post driver of claim 1, wherein the rectangular sleeve has a closed upper end.

4. The post driver of claim 1, wherein the rectangular sleeve has a closed upper end.

5. A post driver, comprising:

a frame portion and a post-driving portion slidably connected to the frame portion;

a piston slidably disposed within a cylinder which divides the cylinder into two chambers, wherein the piston is connected to one of the frame and post-driving portions of the post driver, and the cylinder is connected to the other of the frame and post-driving portions of the post driver; and a spool valve adapted for receiving pressurized fluid from a source and repetitively alternately diverting the pressurized fluid into the two chambers so as to cause the piston to reciprocate in the cylinder and the post-driving portion to reciprocate relative to the frame portion, wherein the post-driving portion includes a rectangular sleeve having an open lower end for receiving a post therethrough and a closed upper end.

* * * * *